US006964470B2

(12) United States Patent
Kagami

(10) Patent No.: US 6,964,470 B2
(45) Date of Patent: Nov. 15, 2005

(54) INK-JET RECORDING UNIT, INK-JET RECORDING METHOD AND RECORDING HEAD CLEANING METHOD FOR INK-JET RECORDING UNIT

(75) Inventor: Tamito Kagami, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/663,806

(22) Filed: Sep. 17, 2003

(65) Prior Publication Data

US 2004/0227790 A1 Nov. 18, 2004

(30) Foreign Application Priority Data

Sep. 18, 2002 (JP) ..... 2002-271315

(51) Int. Cl.[7] ..... B41J 2/06
(52) U.S. Cl. ..... 347/55
(58) Field of Search ..... 347/22, 27, 28, 347/54, 55, 68, 70–72, 144, 120, 123, 111, 347/141, 159, 151, 128, 18

(56) References Cited

U.S. PATENT DOCUMENTS 6,172,693 B1 * 1/2001 Minemoto et al. ..... 347/55

FOREIGN PATENT DOCUMENTS

JP 10-230608 A 9/1998 ..... B41J 2/06
JP 10203608 * 9/1998 ..... B41J 2/06

* cited by examiner

*Primary Examiner*—Juanita D. Stephens
(74) *Attorney, Agent, or Firm*—Sughrue Mion, PLLC

(57) ABSTRACT

The ink-jet recording unit and method apply a voltage identical in polarity with charged colorant particles agglomerated at a tip of each of ink guides to an ejecting electrode, eject ink from the tip and shake the colorant particles at the tip to agglomerate the colorant particles at the tip in preparation for a subsequent ejection of the ink. The recording head cleaning method for the ink-jet recording unit fills the ink channel with a cleaning solution and shakes the cleaning solution to clean the ink guides.

17 Claims, 6 Drawing Sheets

INK-JET RECORDING UNIT, INK-JET RECORDING METHOD AND RECORDING HEAD CLEANING METHOD FOR INK-JET RECORDING UNIT

BACKGROUND OF THE INVENTION

The present invention relates to an ink-jet recording unit, an ink-jet recording method and a recording head cleaning method for the ink-jet recording unit employed by electronic equipment such as a printer, a facsimile, and a copier. The present invention relates in particular to a technology which guides ink to the tip of an ink guide arranged in an ink channel to feed ink in the form of a dispersion of charged colorant particles in a solvent to agglomerate the colorant particles, applies a voltage having the same polarity as that of the colorant particles to an ejecting electrode positioned between the ink level in the ink channel and the tip of the ink guide, thereby ejecting the ink from the tip of the ink guide by way of a repulsion exerted between the ejecting electrode and the colorant particles and ejecting the ink onto a recording medium for recording onto the recording medium, and further in particular to a technology useful in preventing adhesion of colorant particles to the inner wall of the ink guide and removing the caked-on colorant particles.

As a prior art recording unit, for example a technology described in JP 10-230608 A is known. The concept of an ink-jet recording unit described in JP 10-230608 A is explained below.

FIG. 10 is a conceptual illustration explaining a recording head illustrating a prior art ink-jet recording unit. The ink-jet recording unit 40 comprises a plurality of ink guides 42 formed in a linear arrangement in a horizontal direction in FIG. 10, each formed in the shape of an inverted T so as to support by a horizontal face of a bottom section 47 a notch-shaped narrow (or trickle) channel 41 open in the vertical direction as shown to guide ink in the form of a dispersion of charged colorant particles in a solvent to a tip open by way of the capillary action, so that the narrow channel 41 will extend in the vertical direction as shown.

Further, the ink-jet recording unit 40 generally comprises a counter electrode 43 provided on recording medium support means (not shown) supporting a recording medium P in a location opposed to the tip of the ink guide 42, an ejecting electrode 45 arranged on an insulated substrate 44 in close proximity to the ink guide 42 apart from the tip of the ink guide 42, a high-voltage pulse application unit 46 for applying a high-voltage pulse having the same polarity as that of the charged colorant particles to the ejecting electrode 45, and a through hole 48 formed in the insulated substrate 44 at a position corresponding to the arrangement of the ink guide 42.

The section between the bottom section 47 of the ink guide 42 and the insulated substrate 44 functions as a channel 49 where ink flows from right to left in the figure. Thus, a bottom plate (not shown) forming a wall of the channel 49 is arranged on the bottom section 47. The ink guide 42 penetrates the through hole 48 of the insulated substrate 44. The tip of the ink guide 42 protrudes above the topside of the insulated substrate 44 as shown.

FIG. 11 is a perspective view of a recording head illustrating a prior art ink-jet recording unit. Each ejecting electrode 45 is provided in a ring shape on the topside of the insulated substrate 44 as shown to surround the through hole 48 in the insulated substrate 44.

On the ink-jet recording unit 40 of the above configuration, at least one ink guide 42 is attached to a single enclosure (not shown) to form a single recording head. At least either the enclosure of the recording head or a recording medium P is moved to relatively move each other so as to perform recording approximately all over the recording medium P.

In the ink-jet recording unit 40 of the above configuration, the ink including colorant particles travels in the narrow channel 41 and accumulates at the tip of the ink guide 42 by way of the capillary action. In this state, a high-voltage pulse is applied to the ejecting electrode 45. A repulsion exerted between the ejecting electrode 45 and the colorant particles is used to eject the ink including colorant particles in units of droplets from the ink guide 42 to allow the ink to fly to the recording medium P, thereby depositing droplets of ink and recording characters and pictures in dots.

When the high-voltage pulse is applied to the ejecting electrode 45, the ink travels in the narrow channel 41 towards the tip of the ink guide 42 by way a repulsion exerted between the ejecting electrode 45 and the colorant particles, apart from the force caused by the capillary action. While the ejecting electrode 45 is at a ground potential, the field strength in close proximity to the tip of the ink guide 42 is so low that the ink is not ejected from the tip of the ink guide 42. To the counter electrode 43 is applied a voltage having a polarity different from the polarity of the charged colorant particles. Thus, the colorant particles constituting the ink ejected from the ink guide 42 are pulled toward the counter electrode 43 so that the ink is surely adhered to the recording medium.

However, according to a prior art ink-jet recording unit, the ink in the narrow channel provided in the ink guide travels by way of the capillary action and accumulates at the tip of the ink guide. In case the ink is not ejected in this state, the solvent of the ink at the tip may evaporate thus depositing the colorant particles in the narrow channel. Deposition of colorant particles in the narrow channel disturbs the ejection thus preventing drawing of crisp images and characters on a recording medium. As the colorant particles deposit further, the amount of ink ejected from each ink guide is reduced, thus causing the dot diameter for drawing on a recording medium to be erroneous and preventing ejection of ink, which interferes with drawing.

Thus, in general, on an ink-jet recording unit, it is necessary to clean the ink channel including a recording head after drawing. However, according to a prior art recording head cleaning method for an ink-jet recording unit, the only action is to release a cleaning solution into a channel for cleaning. This cannot completely remove the caked-on colorant particles.

SUMMARY OF THE INVENTION

The invention has been accomplished in view of the aforementioned circumstances and aims at providing an ink-jet recording unit which is capable of stabilizing the travel of ink at the tip of an ink guide and preventing adhesion of colorant particles to the inner wall of the ink guide for smooth ejection of ink as well as removing caked-on colorant particles.

Another object of the invention is to provide an ink-jet recording method used in the ink-jet recording unit.

Still another object of the invention is to provide a recording head cleaning method for the ink-jet recording unit.

In order to attain the first object, the invention provides an ink-jet recording unit comprising ink guides each of which is arranged in an ink channel to feed ink in a form of a dispersion of charged colorant particles in a solvent, has a tip protruded from an ink level in the ink channel, and guides the ink to the tip to agglomerate the colorant particles and ejects the ink having the agglomerated colorant particles; ejecting electrodes each of which is positioned between the ink level and the tip of each of the ink guides in a height direction of the ink guides and is provided in close proximity to each of the ink guides; voltage application means which applies to the ejecting electrodes a high-voltage pulse which is identical in polarity with the charged colorant particles to thereby allow the ink containing the colorant particles agglomerated at the tip of each of the ink guides to be ejected; shaking means which shakes the ink guided by the ink guides; and operation control means which controls an operation of the shaking means. The colorant particles may be of any color as long as the colorant particles are particulates for drawing by way of color contrast against a base on a recording medium, as well as a set of three colors, yellow, cyan and magenta (for color printing) and black color only (for monochrome printing).

According to this configuration, it is possible to prevent adhesion of colorant particles to the inner wall of the ink guide and remove caked-on colorant particles in the ink guide. In particular, according to this configuration, it is possible to remove the colorant particles which have adhered to the inner wall of the ink guide by filling the ink channel with a cleaning solution and shaking the cleaning solution instead of ink during cleaning work. In this case, the cleaning solution is preferably shaken at a highest possible frequency. According to this configuration, it is possible to stabilize the travel of ink at the tip of the ink guide and prevent adhesion of colorant particles to the inner wall of the ink guide as well as remove the caked-on colorant particles for smooth ejection of ink.

The shaking means may be arranged to shake ink per at least one ink guide. For example, the shaking means may be arranged to shake ink for each ink guide of the recording head. The shaking means may be arranged to shake the ink for all of the ink guides of the recording head. Further, the shaking means may be arranged to shake the ink for each ink guide block including a plurality of ink guides of the recording head.

The shaking means is preferably provided so that an ink shaking direction conforms to an ink ejecting direction. According to this configuration, the ink shaking direction conforms to the ink ejecting direction, so that it is possible to eject ink without the motion of ink caused by vibration interfering with the ejecting operation by way of an electric force.

Preferably, the shaking means is a self-vibrating body arranged in close proximity to the ink guides and transmits vibration to the ink guides to vibrate the ink guides thereby shaking the ink guided to the tip of each of the ink guides. According to this configuration, the vibrating body can vibrate the ink guide and shake the ink in the narrow channel.

The vibrating body is preferably arranged on a base side of the ink guides opposite to the tip of each of the ink guides. According to this configuration, when the vibration of the vibrating body is transmitted to the ink guide, the ink guide vibrates in the ink ejecting direction. Thus, during recording operation, a vibrating force and an electric force act on the ink. Even when the amplitude of a high-voltage pulse applied by the high-voltage pulse application means is reduced, it is possible to eject ink. Further, it is possible to remove colorant particles which have adhered to the inner wall of the ink guide and wash the colorant particles off the tip of the ink guide.

At least a part of each of the ink guides comprises preferably a self-vibrating body and the tip of each of the ink guides is arranged as the shaking means. According to this configuration, the ink guide itself vibrates to shake the ink at the tip of the ink guide.

The shaking means is preferably a vibrating body arranged in the ink channel in close proximity to the ink guides. According to this configuration, it is possible to propagate the vibration generated by the vibrating body to shake the ink in the ink guide. It is thus possible to remove colorant particles which have adhered to the inner wall of the ink guide and wash away the caked-on colorant particles.

The operation control means preferably applies to the shaking means a voltage below a predetermined value at which the ink is ejected except in an ejection period in which a voltage above the predetermined value required to eject the ink from the tip of each of the ink guides is applied to the ejecting electrode, so as to shake the colorant particles at the tip of each of the ink guides.

According to this configuration, it is possible to promptly agglomerate colorant particles at the tip of the ink guide where colorant particles are scant, as well as prevent adhesion of colorant particles to the inner wall of the ink guide and removing the colorant particles which have adhered to the inner wall of the ink guide except in the ejection period. Thus, it is possible to prevent reduction in the dot size and thinning-out of dots during drawing, thereby allowing high-speed drawing. As a result, according to an ink-jet recording unit of this configuration, it is possible to reduce the drawing time compared with the prior art. The "except in the ejection period" includes the time before and after ejection of ink from the tip of the ink guide and the ejection standby time and equipment idle time.

Preferably, when the ink having the agglomerated colorant particles is ejected from the tip of each of the ink guides at predetermined intervals, the operation control means shakes the ink having the agglomerated colorant particles at the tip of each of the ink guides with the application of a voltage to the ejecting electrode so as to eject the ink having the agglomerated colorant particles from the tip of each of the ink guide.

According to this configuration, the operation control means shakes the agglomerated colorant particles at the tip of the ink guide to give the colorant particles a kinetic energy and ejects ink from the tip of the ink guide with a potential energy of an electric field generated by a voltage applied to the ejecting electrode. This reduces the value of a voltage applied to the ejecting electrode.

Preferably, when the ink having the agglomerated colorant particles is ejected from the tip of each of the ink guides at predetermined intervals, the operation control means keeps applying to the shaking means a voltage below a predetermined value required to eject the ink continuously in an ejection period in which a voltage above the predetermined value required to eject the ink is applied to the ejecting electrode and except in the ejection period, thus shaking the colorant particles at the tip of each of the ink guides.

The expression "when the ink having the agglomerated colorant particles is ejected from the tip of each of the ink guides at predetermined intervals" means that ink is ejected continuously in dots at short intervals from the tip of the ink guide. The short intervals include intervals where ink in dots can be ejected continuously from the ink guide. According to this configuration, it is possible to shake ink by way of a voltage applied to the ejecting electrode and ink shaking at the tip of the ink guide in the ink ejection period. Thus, it is possible to reduce the voltage applied to the ejecting electrode, compared with a case where ink is not shaken. It is also possible to agglomerate colorant particles at the tip of the ink guide where colorant particles are scant and prevent adhesion of colorant particles to the inner wall of the ink guide. In the ink ejection period, ink is ejected by way of a kinetic energy generated by vibration of colorant particles and a potential energy of an electric field. Thus, it is possible to reduce a voltage above a predetermined value required to eject ink from the tip of the ink guide, compared with a case where ink is not shaken. Ink shaking may be done intermittently. This requires less power consumption than when ink is shaken continuously.

The operation control means preferably comprises a radio frequency power supply which applies a radio frequency power to the shaking means and timing signal generation means which generates a timing signal to operate the radio frequency power supply. The radio frequency power supply generates the radio frequency power having a frequency equal to an ejection frequency or integral multiple of the ejection frequency and shakes the ink in synchronization with an ejecting operation. According to this configuration, it is possible to synchronize the ejecting operation with the vibrating operation. Assuming the ejection frequency is in the range of 5 through 20 kHz, a timing signal having a frequency equal to the value or integral multiple of the value is to be generated.

The invention also provides an ink-jet recording method comprising the steps of:

applying a voltage identical in polarity with charged colorant particles agglomerated at a tip of each of ink guides arranged in an ink channel to feed ink in a form of a dispersion of the charged colorant particles in a solvent, to an ejecting electrode positioned between an ink level in the ink channel and the tip of each of the ink guides, thereby ejecting the ink from the tip of each of the ink guides; and shaking the colorant particles at the tip of each of the ink guides to agglomerate the colorant particles at the tip of each of the ink guides in preparation for a subsequent ejection of the ink.

According to this configuration, by shaking the colorant particles at the tip of the ink guide immediately after ejection of ink, it is possible to add colorant particles to the tip of the ink guide with scant colorant particles. This makes it possible to perform next ejection after a short interval. The colorant particles at the tip of the ink guide vibrate so that adhesion of colorant particles is prevented. This avoids reduction in the dot size and thinning-out of dots during drawing, thereby allowing high-speed drawing. As a result, it is possible to reduce the drawing time compared with the prior art.

The invention further provides another ink-jet recording method comprising the steps of:

applying a voltage identical in polarity with charged colorant particles agglomerated at a tip of each of ink guides arranged in an ink channel to feed ink in a form of a dispersion of the charged colorant particles in a solvent, to an ejecting electrode positioned between an ink level in the ink channel and the tip of each of the ink guides;

shaking the colorant particles agglomerated at the tip of each of the ink guides; and ejecting the ink from the tip of each of the ink guides so that the ink flied onto a recording medium is adhered to the recording medium for recording.

According to this configuration, ink is ejected by way of a kinetic energy generated by vibration of colorant particles and a potential energy of an electric field. Thus, it is possible to reduce a voltage above a predetermined value required to eject ink from the tip of the ink guide, compared with a case where ink is not shaken. The colorant particles at the tip of the ink guide are vibrated. This prevents adhesion of colorant particles.

A recording head cleaning method for an ink-jet recording unit in which ink is guided to the tip of each of ink guides arranged in an ink channel to feed the ink in a form of a dispersion of charged colorant particles in a solvent to thereby agglomerate the colorant particles, a voltage identical in polarity with the colorant particles is applied to an ejecting electrode positioned between an ink level in the ink channel and the tip of each of the ink guides, and the ink is ejected from the tip of each of the ink guides by way of a repulsion exerted between the ejecting electrode and the colorant particles to let the ink fly towards a recording medium for recording onto the recording medium, the method comprising the steps of:

filling the ink channel with a cleaning solution; and shaking the cleaning solution to clean the ink guides.

According to this configuration, it is possible to remove colorant particles which have adhered to the inner wall of the ink guide. The cleaning solution can be shaken by way of the vibration of the ink guide, transmission of a vibration from a vibrating body to the ink guide, or the vibration of the vibrating body in an ink channel apart from the ink guide. In this case, such a vibration preferably has a frequency higher than the ejection frequency. For example, the frequency is preferably in the range of 28 through 45 kHz.

DETAILED DESCRIPTION OF THE INVENTION

The ink-jet recording unit, the ink-jet recording method and the recording head cleaning method for the ink-jet recording unit according to the invention are detailed below with reference to the embodiments showing in the attached drawings as required. The invention is not limited to the embodiments described below. It is to be understood that a configuration practically the same as a configuration of the invention is within the scope of the invention.

[Embodiment 1]

Figure 1:
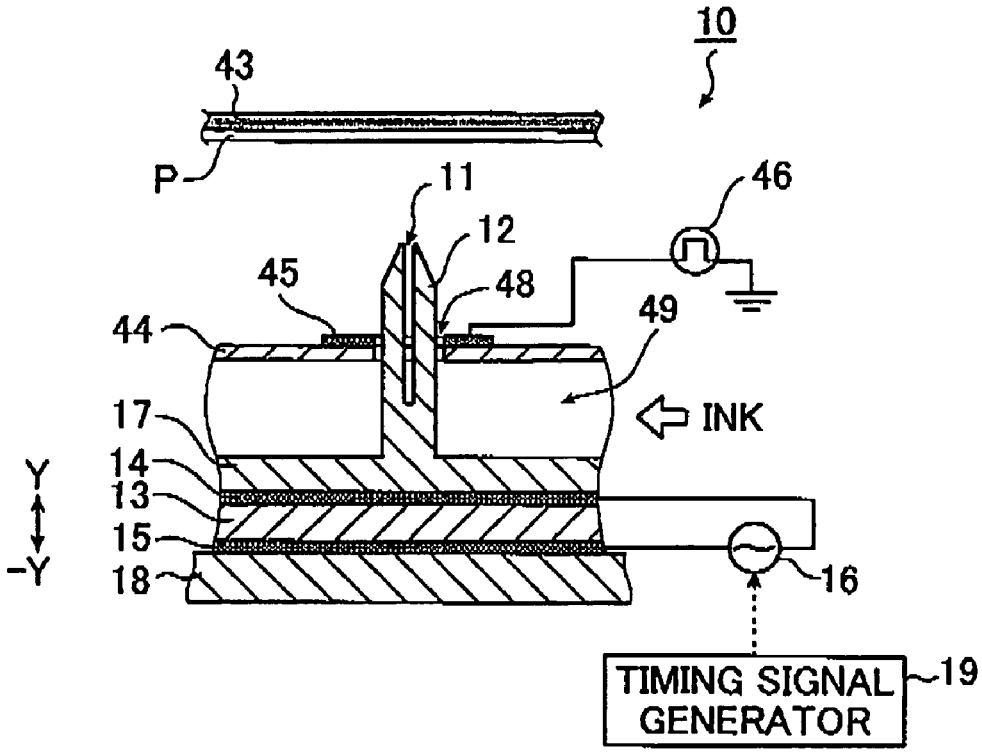
FIG. 1 is a conceptual illustration explaining an ink-jet recording unit according to Embodiment 1 of the invention.
Figure 10:
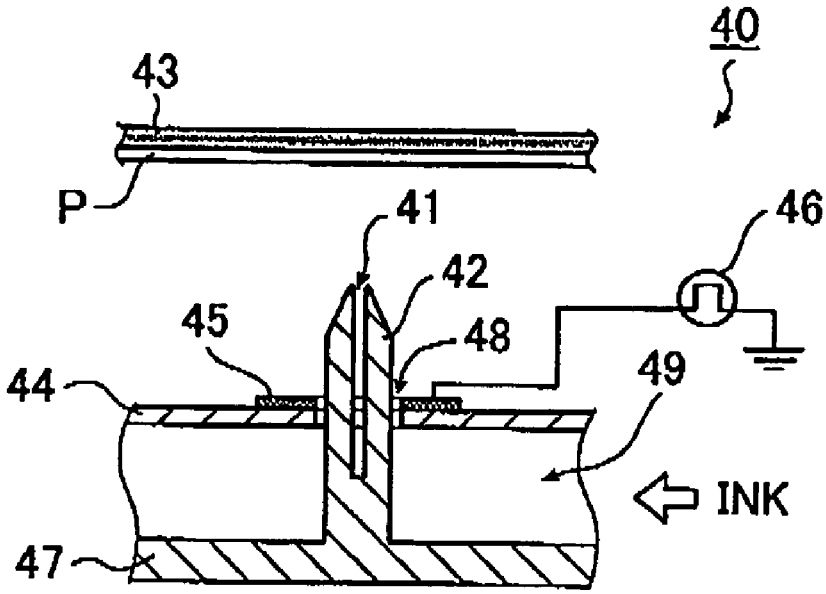
FIG. 10 PRIOR ART
FIG. 10 is a conceptual illustration explaining a prior art ink-jet recording unit.
Figure 11:
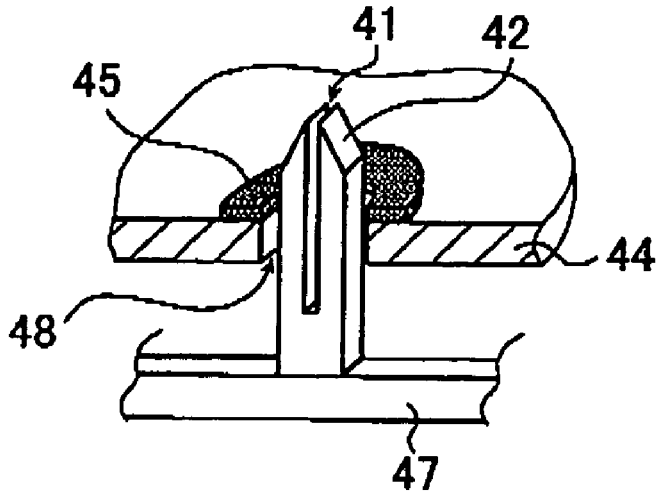
FIG. 11 PRIOR ART
FIG. 11 is a perspective view of a recording head for illustrating a prior art ink-jet recording unit.

FIG. 1 is a conceptual illustration explaining an ink-jet recording unit according to Embodiment 1 of the invention. The same components as the prior art components shown in FIGS. 10 and 11 are given the same signs and numerals. An ink-jet recording unit 10 comprises a plurality of ink guides 12 formed in a horizontally linear arrangement as shown, each formed in the shape of an inverted T so as to support by a horizontal face of a bottom section 17 a notch-shaped narrow channel 11 open in a vertical direction in FIG. 1 to guide ink as a dispersion of charged colorant particles in a solvent to a tip open by way of the capillary action so that the narrow channel 11 will extend in the vertical direction in FIG. 1. The ink guides 12 penetrate through holes 48 of an insulated substrate 44. The tip of each ink guide 12 protrudes above the topside of the insulated substrate 44 as shown in FIG. 1. The ink guide 12 may be formed to integrate a convex section provided with the narrow channel 11 with the bottom section 17 formed in a rod shape, or formed with the convex section attached thereto by way of fixing means such as adhesive and a screw mechanism. The colorant particles may be of any color as long as the colorant particles are particulates for drawing by way of color contrast against a base on a recording medium, as well as a set of three colors, yellow, cyan and magenta (for color printing) and black color only (for monochrome printing).

The ink-jet recording unit 10 further comprises a counter electrode 43 provided on recording medium support means supporting a recording medium P in a location opposed to the tip of the ink guide 12, an ejecting electrode 45 arranged on the insulated substrate 44 in close proximity to the ink guide 12, at a distance from the recording medium P longer than the distance between the tip of the ink guide 12 and the recording medium P, a high-voltage pulse application unit 46 for applying a high-voltage pulse having the same polarity as that of the electric charge of the colorant particles to the ejecting electrode 45, and the through holes 48 in the insulated substrate 44 in a location corresponding to the arrangement of the ink guides 12.

The wall of the substrate 18 functions, together with a wall of the insulated substrate 44, as a channel 49 where ink flows from right to left in FIG. 1. As in the prior art ejecting electrode 45, each ejecting electrode 45 is provided in a ring shape on the topside of the insulated substrate 44 as shown in FIG. 1 so as to surround the through hole 48 in the insulated substrate 44.

The ink-jet recording unit 10 further comprises a piezoelectric element 13 arranged under the bottom section 17, electrodes 14, 15 arranged on the topside and underside of the piezoelectric element 13 as shown, a radio frequency power supply 16 for applying a radio frequency power to the electrodes 14, 15, a substrate 18 supporting the underside of the piezoelectric element 13, and a timing signal generator 19 for generating a timing signal for a radio frequency power supplied by the radio frequency power supply 16.

The piezoelectric element 13 is formed with piezoelectric ceramics such as PZT or lead zirconate titanate. The piezoelectric element 13 vibrates in the vertical direction (direction of arrow Y-(−Y)) in FIG. 1 when a radio frequency power is applied to the electrodes 14, 15.

The vibration is transmitted to the ink guide 12 via the bottom section 17 to shake the ink in the narrow channel 11. This vibration shakes the ink in the narrow channel 11 and causes the ink to repeatedly collide against the inner wall of the narrow channel 11. The colorant particles of the ink do not agglomerate into larger particles in the narrow channel 11 or remain in close proximity to the inner wall of the narrow channel 11. Thus the colorant particles do not adhere to the inner wall of the narrow channel 11.

Even in case the colorant particles are agglomerated into larger particles or adhere to the inner wall of the narrow channel 11, it is possible to split larger particles into smaller ones or remove caked-on colorant particles by shaking the ink. In case the ink has adhered to the inner wall of the narrow channel 11, by filling the narrow channel 11 with a cleaning solution and vibrating the piezoelectric element 13, the cleaning solution in the narrow channel 11 is shaken and the colorant particles which have adhered to the inner wall are removed.

When the piezoelectric element 13 is vibrated in a state where ink is not agglomerated at the tip of the narrow channel, such as just after ink ejection, the ink in the narrow channel 11 is shaken and the ink guided through the narrow channel 11 by way of the capillary action undergoes a force caused by vibration. This helps the travel of ink by way of the capillary action and accumulates ink at the tip of the ink guide 12 more smoothly and faster than the travel by way of the capillary action alone. This accelerates coagulation of colorant particles at the tip of the ink guide 12, thus preventing reduction in the dot size and thinning-out of dots during drawing, thereby allowing high-speed and correct drawing.

The radio frequency power supply 16 applies a radio frequency power to the electrodes 14, 15 based on a timing signal generated by the timing signal generator 19.

The radio frequency power supply 16 functions as means for synchronizing the ejecting operation with the vibration operation by making the timing signal generator 19 generate a timing signal having a frequency equal to an ejection frequency or integral multiple of the ejection frequency. Assuming the ejection frequency is in the range of 5 through 20 kHz, a timing signal having a frequency equal to this value or integral multiple of this value is to be generated. The timing signal generator 19 functions as means for making shaking of ink assist ejecting operation by way of an electric force by generating a timing signal to shake ink in its ejection direction in synchronization with a high-voltage pulse with which ink is ejected in the ejection direction.

The timing signal generator 19 functions as means for preventing ink from ejecting from an ink guide which is not in ejecting operation and thus recording onto a recording medium by correct ink ejection by generating a timing signal for shaking ink while the ink is not ejected from the tip of the narrow channel 11. The timing signal generator 19 also functions as means for removing and expelling colorant particles which have adhered to the inner wall of the narrow channel by generating a timing signal to shake ink so as to cause the ink to fly from the tip of the narrow channel 11 and filling the narrow channel with a cleaning solution instead of ink to perform vibration operation.

The timing signal generator 19 also functions as means for assisting the travel of ink by way of the capillary action with ink shaking by generating a timing signal to shake ink before the ink is ejected from the narrow channel 11. The timing signal generator 19 also functions as means for generating a timing signal to shake ink with the timing of ejection of ink from the narrow channel 11 thus assisting ink flight from the tip of the ink guide 12 as well as preventing adhesion of ink to the narrow channel 11.

The timing signal generator 19 may intermittently generate a timing signal for vibrating the ink guide 12 to reduce the power consumption of the radio frequency power supply 16, as well as continuously generate a timing signal for vibrating the ink guide 12 during ejecting operation or before and after ejecting operation.

Figure 2:
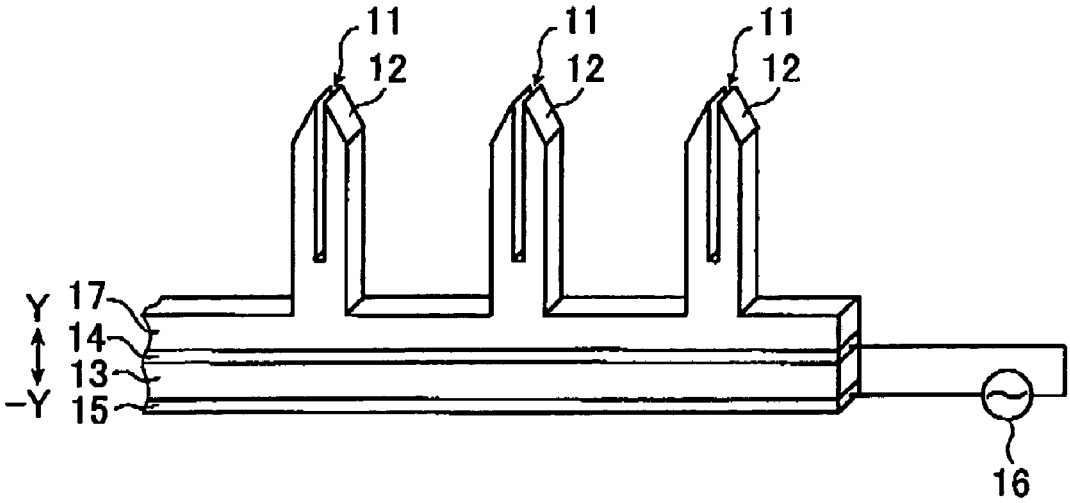
FIG. 2 is a perspective view of an ink guide used for the ink-jet recording unit according to Embodiment 1 of the invention.

FIG. 2 is a perspective view of an ink guide used for the ink-jet recording unit according to Embodiment 1 of the invention. The plurality of ink guides 12 are formed in a linear arrangement as mentioned earlier. Thus, the bottom section 17 forms a rod-shaped base of the ink guides 12. The piezoelectric element 13 formed in a rod shape is attached to the bottom section 17 via the electrode 14. When a radio frequency power supplied by the radio frequency power supply 16 is applied to the electrodes 14, 15, the piezoelectric element 13 vibrates in the vertical direction (direction of arrow Y-(−Y)) in FIG. 2, thereby shaking the ink in the narrow channel 11 of the ink guide 12.

On the ink-jet recording unit 10 of the above configuration, ink guides 42 are attached to a single enclosure (not shown) to form a single recording head. At least either the enclosure of the recording head or a recording medium P is moved to relatively move each other so as to perform recording approximately all over the recording medium P.

The recording method by the ink-jet recording unit 10 of the above configuration is described below.

In the ink-jet recording unit 10 of the above configuration, the ink including colorant particles travels in the narrow channel 11 and accumulates at the tip of the ink guide 12 by way of the capillary action. In this state, the radio frequency power supply 16 applies a radio frequency power to the electrodes 14, 15 to vibrate the piezoelectric element 13 thus shaking the colorant particles in the narrow channel 11 and assisting the travel of the ink by way of the capillary action, thereby promptly coagulating the ink at the tip of the ink guide 12.

In this state, a high-voltage pulse is applied to the ejecting electrode 45. A repulsion exerted between the ejecting electrode 45 and the colorant particles is used to eject the ink including colorant particles in units of droplets from the ink guide 12 to let the ink fly to the recording medium P, thereby depositing droplets of ink and recording characters and pictures in dots. With this ejecting operation, the radio frequency power supply 16 applies a radio frequency power to the electrodes 14, 15 to vibrate the piezoelectric element 13. The ink agglomerated at the tip of the ink guide 12 undergoes a repulsion caused by an electric field given by the ejecting electrode 45 and a vibrating power. This ejects the ink from the tip of the ink guide 12.

While the ejecting electrode 45 is at a ground potential, the field strength in close proximity to the tip of the ink guide 12 is so low that the ink is not ejected from the tip of the ink guide 12.

To the counter electrode 43 is applied a voltage having a polarity different from the polarity of the electric charge of the colorant particles. Thus, as mentioned earlier, the colorant particles constituting the ink ejected from the ink guide 12 as a result of application of a high voltage to the ejecting electrode 45 are pulled toward the counter electrode 43 so that the ink is surely adhered to the recording medium P.

As mentioned earlier, the ink in the narrow channel 11 is shaken during recording operation and before and after recording operation so that the ink is stably elected from the ink guide 12 without adhering to the narrow channel 11. Even in case the ink has adhered to the inner wall of the narrow channel 11, the ink is shaken so that it is possible to remove the ink before adhesion develops.

A recording head cleaning method for the ink-jet recording unit according to Embodiment 1 of the invention is described below. In the cleaning practice, the narrow channel 11 and the channel 49 are filled with a cleaning solution instead of ink. A radio frequency power generated by the radio frequency power supply 16 during this cleaning work preferably has an amplitude and a frequency sufficient to eject ink. Such a frequency is for example in the range of 28 through 45 kHz.

As mentioned above, with the narrow channel 11 and the channel 49 filled with a cleaning solution, the radio frequency power supply 16 applies a radio frequency power to the electrodes 14, 15 to vibrate the piezoelectric element 13 thus shaking the cleaning solution in the narrow channel 11, removing the colorant particles which have adhered to the inner wall of the narrow channel 11, ejecting ink from the tip of the ink guide 12 as well as discharging the caked-on ink together with the cleaning solution from a liquid waste outlet (not shown). In this way, cleaning the ink through vibration reduces the cleaning time and amount of cleaning solution used, compared with a case where vibration is not provided.

While the bottom section 17 for the ink guides 12 is formed in a rod shape and the rod-shaped bottom section 17 is used to vibrate all the ink guides 12 in a linear arrangement in the foregoing example, the ink guides 12 may vibrate individually (Variation 1) or the plurality of ink guides 12 may vibrate per block (Variation 2). These ink guides are detailed below.

Figure 3:
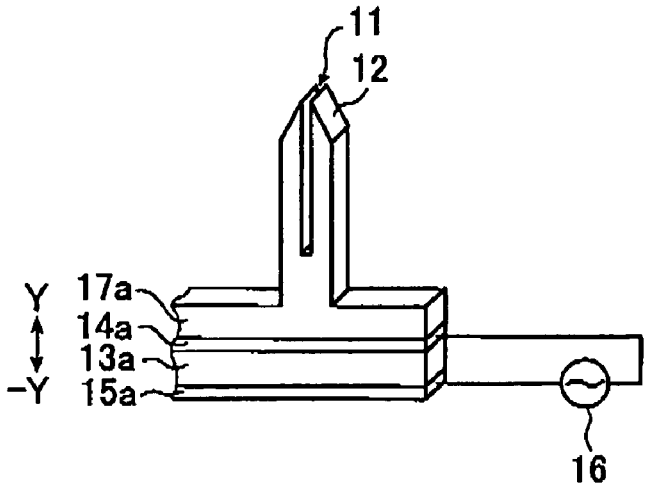
FIG. 3 is a perspective view illustrating Variation 1 of the ink guide used for-the ink-jet recording unit according to Embodiment 1 of the invention.

FIG. 3 is a perspective view illustrating Variation 1 of the ink guide used for the ink-jet recording unit according to Embodiment 1 of the invention. FIG. 3 shows a single ink guide.

A piezoelectric element 13*a* is provided on the underside of a bottom section 17*a* of each ink guide 12 via an electrode 14*a*. When a radio frequency power from the radio frequency power supply 16 is applied to the electrodes 14*a*, 15*a*, the piezoelectric element 13*a* vibrates in a vertical direction (direction of arrow Y-(−Y)) in FIG. 3, thereby shaking the ink in the narrow channel 11 of the ink guide 12.

Figure 4:
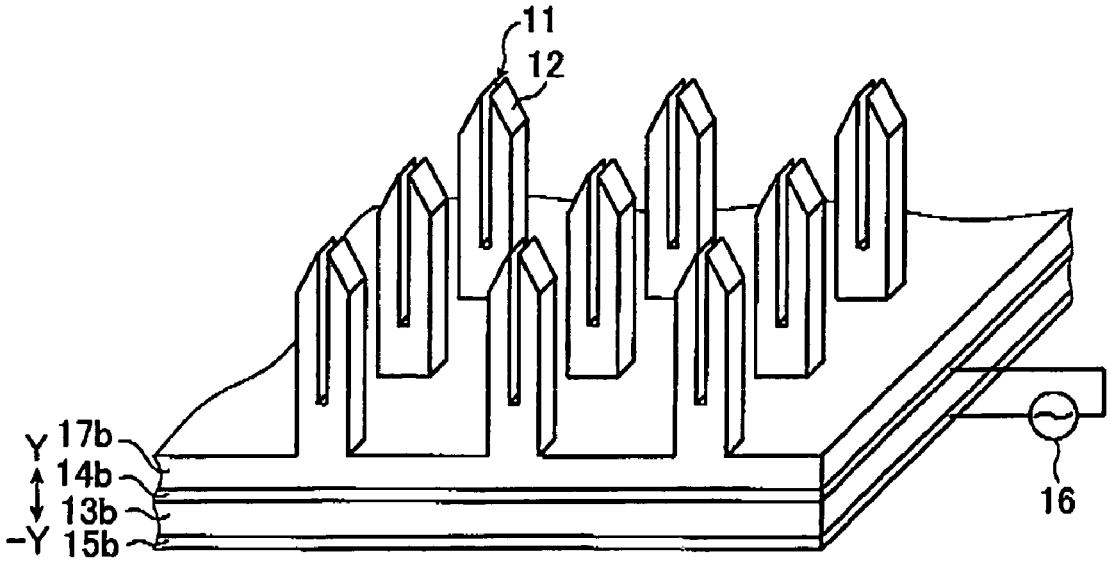
FIG. 4 is a perspective view illustrating Variation 2 of the ink guide used for the ink-jet recording unit according to Embodiment 1 of the invention.

FIG. 4 is a perspective view illustrating Variation 2 of the ink guide used for the ink-jet recording unit according to Embodiment 1 of the invention.

A piezoelectric element 13*b* is provided on the underside of a plate-shaped bottom section 17*b* for a plurality of ink guides 12 via an electrode 14*b* (in FIG. 4, signs and numerals are given to a single ink guide 12 and a single narrow channel 11 alone). When a radio frequency power from the radio frequency power supply 16 is applied to the electrodes 14*b*, 15*b*, the piezoelectric element 13*b* vibrates in a vertical direction (direction of arrow Y-(−Y)) in FIG. 4, thereby shaking the ink in the narrow channels 11 of the plurality of ink guides 12. All the ink guides 12 may be integrated into a single recording head. Block of ink guides 12 may compose a single recording head, and each block may vibrate individually.

According to Embodiment 1 mentioned above, vibration of the piezoelectric element is transmitted to vibrate the ink guide, thereby shaking the ink in the narrow channel and smoothly guiding the ink to the tip of the ink guide. This process prevents adhesion of colorant particles to the inner wall of the narrow channel, removes the colorant particles which have adhered to the inner wall of the narrow channel and prevents failure to eject ink from the ink guide. In particular, according to this configuration, it is possible to remove colorant particles which have adhered to the inner wall of the narrow channel by filling the narrow channel with a cleaning solution instead of ink and shaking the cleaning solution.

In particular, in case ink is shaken before it is ejected from the narrow channel, the travel of ink by capillary action is assisted by ink shaking. This moves ink faster through the narrow channel than when ink travels by way of the capillary action alone. Then, refilling the tip of the ink guide is made faster. It is thus possible to prevent reduction in the dot size and thinning-out of dots during drawing, thereby allowing high-speed drawing.

The ink in the narrow channel is shaken and smoothly guided to the tip of the ink guide. This process prevents adhesion of colorant particles to the inner wall of the narrow channel and prevents failure to eject ink from the ink guide. In this case, it is possible to reduce the voltage on an ejecting electrode, thus allowing a radio frequency power supply to be replaced with a safer, lower-voltage, general power supply.

[Embodiment 2]

Embodiment 2 differs from Embodiment 1 in terms of the vibration mechanism of an ink guide. In Embodiment 1, the vibration of a piezoelectric element is transmitted to the ink guide to shake the ink. In Embodiment 2, the ink guide itself vibrates to shake the ink. This mechanism is detailed below. In the description of Embodiment 2, same signs and numerals are given to the same components as those of the prior art or Embodiment 1. In case description is similar between Embodiment 1 and Embodiment 2, the signs and numerals at a similar section in Embodiment 1 shall be read as those in Embodiment 2. When there is no particular need to do so, description is omitted. The colorant particles in Embodiment 2 are the same as those in Embodiment 1.

Figure 5:
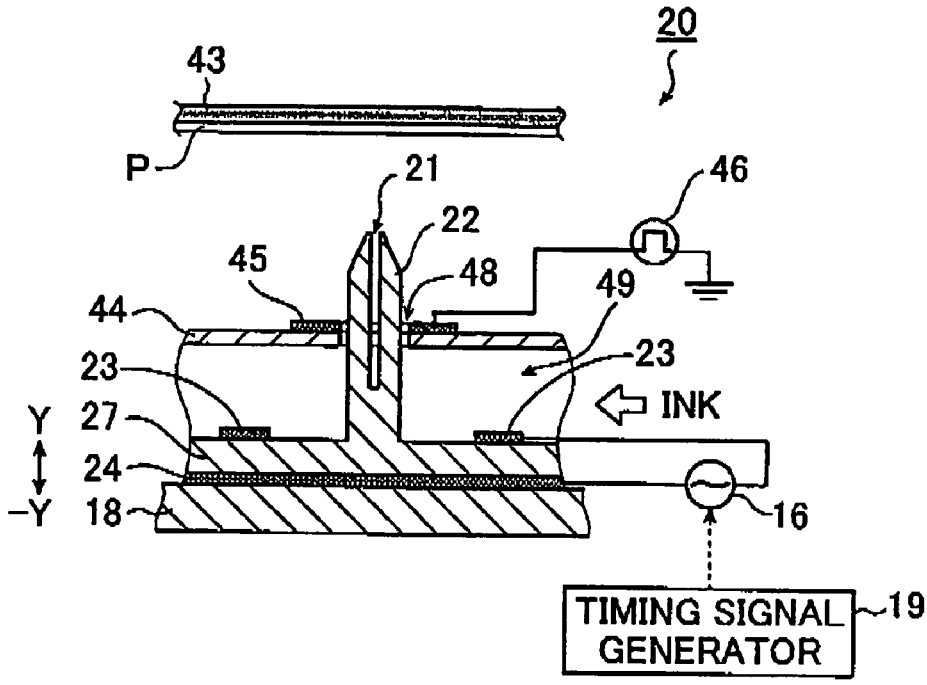
FIG. 5 is a conceptual illustration explaining an ink-jet recording unit according to Embodiment 2 of the invention.

FIG. 5 is a conceptual illustration explaining an ink-jet recording unit according to Embodiment 2 of the invention. The ink-jet recording unit 20 comprises: a plurality of ink guides 22 formed in a horizontally linear arrangement in FIG. 5, each formed in the shape of an inverted T so as to support by a horizontal face of a bottom section 27 a notch-shaped narrow channel 21 open in a vertical direction as shown to guide ink as a dispersion of charged colorant particles in a solvent to a tip open by way of the capillary action so that the narrow channel 21 will extend in the vertical direction in FIG. 5; electrodes 23, 24 respectively provided on the topside and underside of the bottom section 27 as shown; a radio frequency power supply 16 for applying a radio frequency power to the electrodes 23, 24; a substrate 18 supporting the underside of the ink guide 22; and a timing signal generator 19 for generating a timing signal for a radio frequency power supplied by the radio frequency power supply 16.

The ink guide 22 is formed with piezoelectric ceramics such as PZT or lead zirconate titanate. The ink guide 22 vibrates in a vertical direction (direction of arrow Y-(−Y)) in FIG. 5 when a radio frequency power is applied to the electrodes 23, 24.

The vibration shakes the ink in the narrow channel 21. The ink shaking process stirs the ink in the narrow channel 21 and causes the ink to repeatedly collide against the inner wall of the narrow channel 21. The colorant particles of the ink do not agglomerate into larger particles in the narrow channel 21 or remain in close proximity to the inner wall of the narrow channel 21. Thus the colorant particles do not adhere to the inner wall of the narrow channel 21. The function to remove adhered colorant particles with a cleaning solution and the function to shake the colorant particles before and after ejection of ink are the same as those in Embodiment 1, so that the corresponding description is omitted.

A mechanism whereby the ink guide 22 itself vibrates does not require a piezoelectric element 13 arranged underside of the ink guide 22 and thus is appropriate for a low-profile design, unlike the ink guide 12 (Embodiment 1). The ink guide 22 penetrates the through hole 48 of the insulated substrate 44. The tip of the ink guide 22 protrudes above the topside of the insulated substrate 44 as shown. The ink guide 22 may be formed to integrate a convex section provided with the narrow channel 21 with the bottom section 27 formed in a rod shape, or formed with the convex section attached thereto by way of fixing means such as adhesive and a screw mechanism.

The ink-jet recording unit 20 further comprises a counter electrode 43 provided on recording medium support means supporting a recording medium P in a location opposed to the tip of the ink guide 22, an ejecting electrode 45 arranged on an insulated substrate 44 in close proximity to the ink guide 22, at a distance from the recording medium P longer than the distance between the tip of the ink guide 22 and the recording medium P, a high-voltage pulse application unit 46 for applying a high-voltage pulse having the same polarity as that of the electric charge of the colorant particles to the ejecting electrode 45, and through holes 48 in the insulated substrate 44 in a location corresponding to the arrangement of the ink guides 22. Embodiment 2 is similar to Embodiment 2 in that the walls of the substrate 18 function as the channel 49 and that the ejecting electrode 45 is provided in a ring shape.

The radio frequency power supply 16 applies a radio frequency power to the electrodes 23, 24 based on a timing signal generated by the timing signal generator 19. The function of the timing signal generator 19 has been described in Embodiment 1 so that the corresponding description is omitted.

Figure 6:
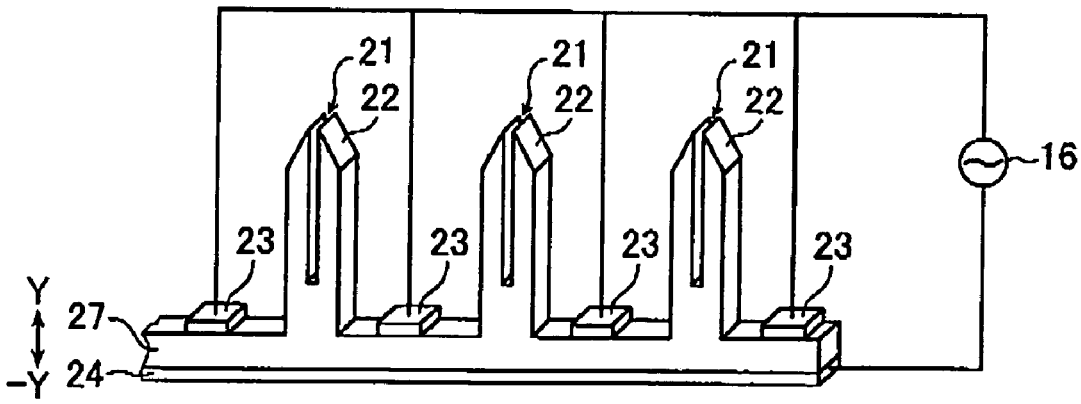
FIG. 6 is a perspective view of an ink guide used for the ink-jet recording unit according to Embodiment 2 of the invention.

FIG. 6 is a perspective view of an ink guide used for the ink-jet recording unit according to Embodiment 2 of the invention. The plurality of ink guides 22 are formed in a linear arrangement as mentioned earlier. Thus, the bottom section 27 is formed in a rod shape. When a radio frequency power supplied by the radio frequency power supply 16 is applied to the electrodes 23, 24, the ink guides 22 vibrate in a vertical direction (direction of arrow Y-(−Y)) as shown, thereby shaking the ink in the narrow channel 21 of the ink guide 22.

The configuration of a recording head is similar to that of Embodiment 1. An ink-jet recording method and a recording head cleaning method for the ink-jet recording unit are the same between Embodiment 1 and Embodiment 2 except that the piezoelectric element 13 vibrates to cause the ink guide 12 to vibrate, thereby shaking the ink or cleaning solution in the narrow channel 11 in Embodiment 1 while the ink guide 22 itself vibrates to shake the ink or cleaning solution in the narrow channel 21 in Embodiment 2. Accordingly, detailed description is given in Embodiment 1, not Embodiment 2.

While the bottom section 27 for the ink guides 22 is formed in a rod shape and the rod-shaped bottom section 27 is used to vibrate all the ink guides 22 arranged in a linear arrangement in the foregoing example, the ink guides 22 may vibrate individually (Variation 1) or the plurality of ink guides may vibrate per block (Variation 2). These ink guides are detailed below.

Figure 7:
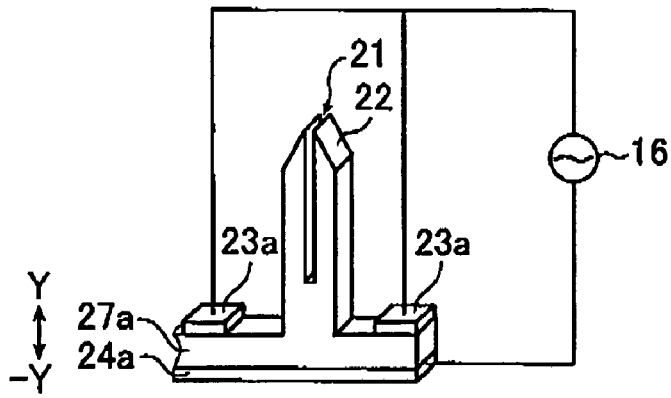
FIG. 7 is a perspective view illustrating Variation 1 of the ink guide used for the ink-jet recording unit according to Embodiment 2 of-the invention.

FIG. 7 is a perspective view illustrating Variation 1 of the ink guide used for the ink-jet recording unit according to Embodiment 2 of the invention. FIG. 7 shows a single ink guide.

An electrode 23*a* is provided on the topside of a bottom section 27*a* of each ink guide 22 and an electrode 24*a* on the underside thereof. According to this configuration, when a radio frequency power from the radio frequency power supply 16 is applied to the electrodes 23*a*, 24*a*, the ink guides 22 vibrate in a vertical direction (direction of arrow Y-(−Y)) as shown, thereby shaking the ink in the narrow channel 21.

Figure 8:
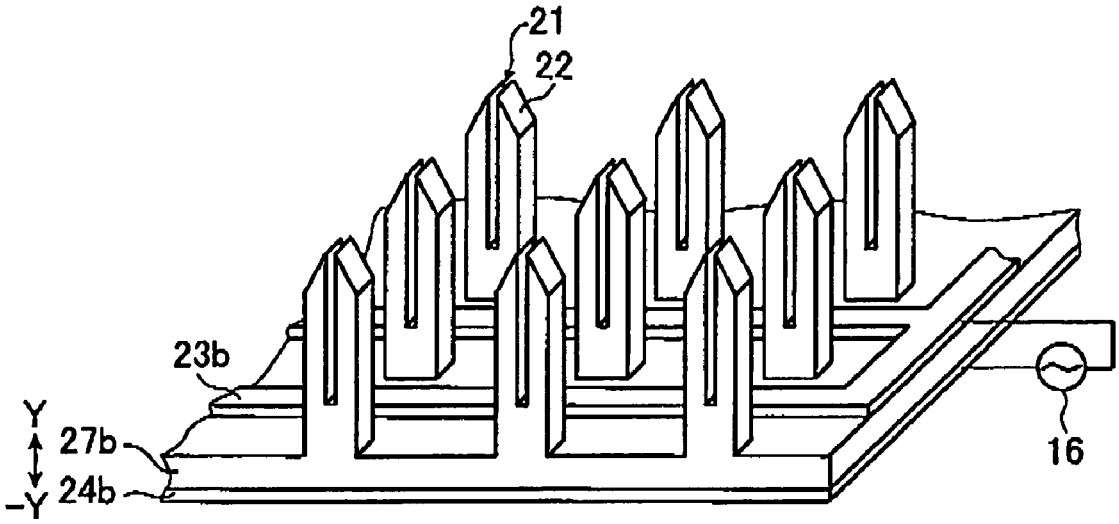
FIG. 8 is a perspective view illustrating Variation 2 of the ink guide used for the ink-jet recording unit according to Embodiment 2 of the invention.

FIG. 8 is a perspective view illustrating Variation 2 of the ink guide used for the ink-jet recording unit according to Embodiment 2 of the invention.

The plurality of ink guides 22 are erected on a plate-shaped bottom section 27*b* (in FIG. 8, signs and numerals are given to a single ink guide 22 and a single narrow channel 21 alone). On the topside of the bottom section 27*b* is provided an electrode 23*b* around the protrusion of each ink guide 22. An electrode 24*b* is provided on the underside of the bottom section 27*b*. When a radio frequency power from the radio frequency power supply 16 is applied to the electrodes 23*b*, 24*b*, the ink guides 22 having the bottom section 27*b* in common vibrate in the vertical direction (direction of arrow Y-(−Y)) as shown, thereby shaking the ink in the narrow channels 21. All the ink guides 22 may be integrated into a single recording head. Each block of ink guides 12 may compose a single recording head, and each block may vibrate individually.

According to Embodiment 2 mentioned above, vibration of the ink guide itself shakes the ink in the narrow channel and smoothly guides the ink to the tip of the ink guide. This process prevents adhesion of colorant particles to the inner wall of the narrow channel, removes the colorant particles which have adhered to the inner wall of the narrow channel and prevents failure to eject ink from the ink guide. In particular, according to this configuration, it is possible to remove colorant particles which have adhered to the inner wall of the narrow channel by filling the narrow channel with a cleaning solution instead of ink and shaking the cleaning solution. Further, in case ink is shaken before it is ejected from the narrow channel, refilling the tip of the ink guide is made faster. It is thus possible to prevent reduction in the dot size and thinning-out of dots during drawing, thereby allowing high-speed drawing.

[Embodiment 3]

Embodiment 3 differs from Embodiments 1 and 2 in terms of the ink shaking mechanism. In Embodiment 1 above, the vibration of a piezoelectric element is transmitted to the ink guide to shake the ink. In Embodiment 2, the ink guide itself vibrates to shake the ink. That is, in Embodiment 1 or 2, the ink guide vibrates to shake the ink in a narrow channel. Meanwhile, in Embodiment 3, the ink in the channel 49 is shaken and the resulting undulations are transmitted to the ink in the narrow channel. This mechanism is detailed below. In the description of Embodiment 3, same signs and numerals are given to the same components as those of the prior art or Embodiments 1 and 2. In case description is similar between Embodiment 3 and Embodiment 1 or 2, the signs and numerals at a similar section in Embodiment 1 or 2 shall be read as those in Embodiment 3. When there is no particular need to do so, description is omitted. The colorant particles in Embodiment 3 are the same as those in Embodiment 1.

Figure 9:
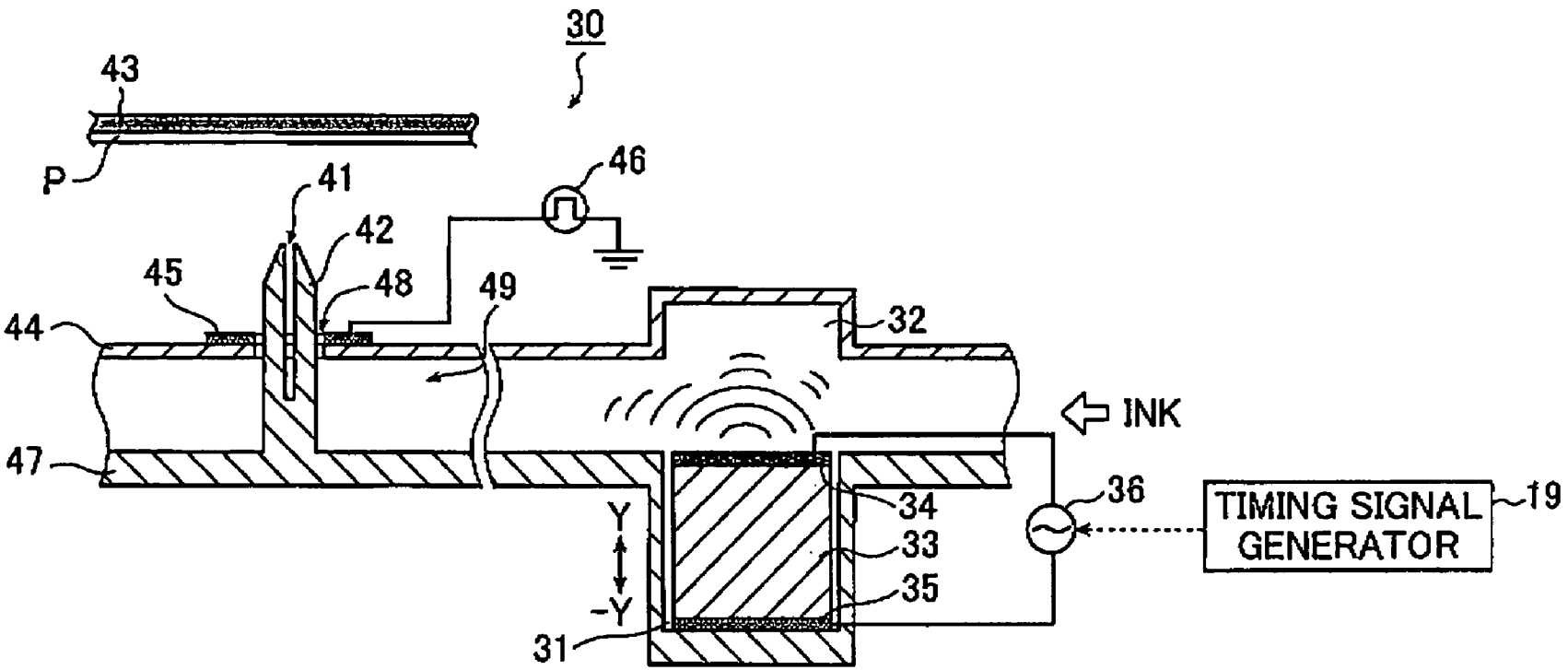
FIG. 9 is a conceptual illustration explaining an ink-jet recording unit according to Embodiment 3 of the invention.

FIG. 9 is a conceptual illustration explaining an ink-jet recording unit according to Embodiment 3 of the invention. As in the prior art ink-jet recording unit 40, the ink-jet recording unit 30 generally comprises: a plurality of ink guides 42 each formed in the shape of an inverted T so as to support a narrow channel 41 by a horizontal face of a bottom section 47 so that the narrow channel 41 will extend in a vertical direction as shown; a counter electrode 43 provided on the side of a recording medium P; an insulated substrate 44, an ejecting electrode 45, a high-voltage pulse application unit 46, and through holes 48. The section between the bottom section 47 and the insulated substrate 44 functions as a channel 49.

Further, the ink-jet recording unit 30 comprises: a piezoelectric element attaching section 31 where the channel 49 branches in a vertical downwards direction in the middle of the channel 49; a pressure buffer 32 for attenuating a pressure wave in a vertical direction, the pressure buffer opposed to the piezoelectric element attaching section 31 and formed at a location where the channel 49 branches; a piezoelectric element 33 attached to the piezoelectric element attaching section 31; electrodes 34, 35 respectively provided on the downside and topside of the piezoelectric element 33; a radio frequency power supply 36 for applying a radio frequency power to the electrodes 34, 35; and a timing signal generator 19 for generating a timing signal for a radio frequency power supplied by the radio frequency power supply 16. The function of the timing signal generator 19 has been described in Embodiment 1 so that the corresponding description is omitted.

The piezoelectric element 33 is formed with piezoelectric ceramics such as PZT or lead zirconate titanate. The piezoelectric element 33 vibrates in a vertical direction (direction of arrow Y-(−Y)) as shown when a radio frequency power is applied to the electrodes 34, 35.

The vibration is transmitted through the channel 49 and shakes the ink in the narrow channel 41. The ink shaking process stirs the ink in the narrow channel 41 and causes the ink to repeatedly collide against the inner wall of the narrow channel 41. The colorant particles of the ink do not agglomerate into larger particles in the narrow channel 41 or remain in close proximity to the inner wall of the narrow channel 41. Thus the colorant particles do not adhere to the inner wall of the narrow channel 41. The function to remove adhered colorant particles with a cleaning solution and the function to shake the colorant particles before and after ejection of ink are the same as those in Embodiment 1, so that the corresponding description is omitted.

The configuration of a recording head is similar to that of Embodiment 1. An ink-jet recording method and a recording head cleaning method for the ink-jet recording unit are the same between Embodiment 1 or 2 and Embodiment 3 except that the piezoelectric element 13 vibrates to cause the ink guide 12 to vibrate, thereby shaking the ink or cleaning solution in the narrow channel 11 in Embodiment 1 and the ink guide 22 itself vibrates to shake the ink or cleaning solution in the narrow channel 21 in Embodiment 2, while the vibration of the piezoelectric element 33 is transmitted via the ink or cleaning solution in the channel 49 to shake the ink or cleaning solution in the narrow channel 41 in Embodiment 3. Accordingly, detailed description is given in Embodiment 1, and is omitted here.

According to Embodiment 3 above, the vibration of the piezoelectric element 33 is transmitted to a narrow channel formed in the ink guide via the ink or cleaning solution in the channel to shake the ink or cleaning solution in the narrow channel, thereby smoothly guiding the ink to the tip of the ink guide. This prevents adhesion of colorant particles to the inner wall of the narrow channel, removes the colorant particles which have adhered to the inner wall of the narrow channel and prevents failure to eject ink from the ink guide. In particular, according to this configuration, it is possible to remove colorant particles which have adhered to the inner wall of the narrow channel by filling the narrow channel with a cleaning solution instead of ink and shaking the cleaning solution to perform cleaning operation. Further, in case ink is shaken before it is ejected from the narrow channel, refilling the tip of the ink guide is made faster. It is thus possible to prevent reduction in the dot size and thinning-out of dots during drawing, thereby allowing high-speed drawing.

While the shape of each of the narrow channels 11, 21, 41 is a notch shape open in the vertical direction of the ink guides 12, 22, 42, other shapes such as a pipe shape and a groove shape may be employed as long as the capillary action take place. A configuration is also allowed where the ink guide is not equipped with a narrow channel and ink is delivered to the tip of the ink guide surface.

While the shape of the ejecting electrode 45 is a ring in Embodiments 1 through 3, a shape arranged in a discontinuous ring may be employed, as well as a continuously formed ring. For example, a plurality of electrodes may be arranged at vertices of a regular polygon such as a square.

While the vibrating body is a piezoelectric element 13 formed with piezoelectric ceramics such as PZT or lead zirconate titanate in Embodiments 1 through 3, a vibrating body using a piezoelectric macromolecular film such as PVDF (polyvinylidene fluoride), ZnO film, or an electromagnetic force generated by a voice coil, or a small motor mass rotation vibrating body may be used instead.

While the ink-jet recording unit, the ink-jet recording method and the recording head cleaning method for the ink-jet recording unit according to the invention have been described above in detail with reference to the embodiments, the invention is by no means limited thereto and various improvements and design modifications can of course be made without departing from the scope and spirit of the invention.

As mentioned hereabove, the invention prevents adhesion of colorant particles to the inner wall of the ink guide and removes the colorant particles which have adhered to the inner wall of the ink guide. In particular, according to the invention, it is possible to remove colorant particles which have adhered to the inner wall of the ink guide by filling the ink channel with a cleaning solution instead of ink and shaking the cleaning solution. Thus, according to the invention, it is possible to stabilize the travel of ink at the tip of an ink guide and prevent adhesion of colorant particles to the inner wall of the ink guide for smooth ejection of ink as well as remove caked-on colorant particles.

Thus, the invention provides an ink-jet recording unit, an ink-jet recording method and a recording head cleaning method for the ink-jet recording unit which are capable of stabilizing the travel of ink at the tip of an ink guide and preventing adhesion of colorant particles to the inner wall of the ink guide for smooth ejection of ink as well as removing caked-on colorant particles.

What is claimed is:

1. An ink-jet recording unit comprising:

ink guides each of which is arranged in an ink channel to feed ink in a form of a dispersion of charged colorant particles in a solvent, has a tip protruded from an ink level in said ink channel, and guides the ink to the tip to agglomerate the colorant particles to eject the ink having the agglomerated colorant particles;

ejecting electrodes each of which is positioned between the ink level and the tip of each of said ink guides in a height direction of said ink guides and is provided in close proximity to each of-said ink guides;

voltage application means which applies to said ejecting electrodes a high-voltage pulse which is identical in polarity with said charged colorant particles to thereby allow the ink containing the colorant particles agglomerated at the tip of each of the ink guides to be ejected;

shaking means which shakes the ink guided by said ink guides; and operation control means which controls an operation of said shaking means, wherein said shaking means is provided so that an ink shaking direction conforms to an ink ejecting direction.

2. The ink-jet recording unit according to claim 1, wherein said shaking means is a self-vibrating body arranged in close proximity to said ink guides and transmits vibration to said ink guides to vibrate said ink guides thereby shaking the ink guided to said tip of each of said ink guides.

3. The ink-jet recording unit according to claim 3, wherein said self-vibrating body is arranged on a base side of the ink guides opposite to the tip of each of the ink guides.

4. The ink-jet recording unit according to claim 1, wherein at least a part of each of said ink guides comprises a self-vibrating body and the tip of each of said ink guides is arranged as said shaking means.

5. The ink-jet recording unit according to claim 1, wherein said shaking means is a vibrating body arranged in said ink channel in close proximity to said ink guides.

6. The ink-jet recording unit according to claim 1, wherein, in a non-ejection period except an ejection period in which an ejecting voltage above a predetermined value required to eject the ink from the tip of each of said ink guides is applied to said ejecting electrode said operation control means applies to said shaking means a shaking voltage below the predetermined value at which the ink is ejected so as to shake the colorant particles at the tip of each of said ink guides.

7. The ink-jet recording unit according to claim 1, wherein, when the ink having the agglomerated colorant particles is ejected from the tip of each of said ink guides at predetermined intervals, said operation control means shakes the ink having the agglomerated colorant particles at the tip of each of said ink guides in an ejection period in which an ejection voltage is applied to said ejecting electrode so as to eject the ink having the agglomerated colorant particles from the tip of each of said ink guide.

8. The ink-jet recording unit according to claim 1, wherein, while the ink having the agglomerated colorant particles is ejected from the tip of each of said ink guides at predetermined intervals, in an ejection period in which an ejecting voltage above a predetermined value required to eject the ink from the tip of each of said ink guides is applied to said ejecting electrode and in a non-ejection period except the ejection period, said operation control means keeps continuously applying to said shaking means a shaking voltage below the predetermined value at which the ink is ejected, thus continuously shaking the colorant particles at the tip of each of said ink guides.

9. The ink-jet recording unit according to claim 1, wherein said ink shaking direction is substantially parallel to an ink ejecting direction.

10. The ink-jet recording unit according to claim 1, wherein said shaking means vibrates said ink guides thereby shaking the ink guided to said tip of each of said ink guides.

11. The ink-jet recording unit according to claim 1, wherein said shaking means vibrates said ink channel thereby shaking the ink guided to said tip of each of said ink guides.

12. An ink-jet recording unit comprising:

ink guides each of which is arranged in an ink channel to feed ink in a form of a dispersion of charged colorant particles in a solvent, has a tip protruded from an ink level in said ink channel, and guides the ink to the tip to agglomerate the colorant particles to eject the ink having the agglomerated colorant particles;

ejecting electrodes each of which is positioned between the ink level and the tip of each of said ink guides in a height direction of said ink guides and is provided in close proximity to each of-said ink guides;

voltage application means which applies to said ejecting electrodes a high-voltage pulse which is identical in polarity with said charged colorant particles to thereby allow the ink containing the colorant particles agglomerated at the tip of each of the ink guides to be ejected;

shaking means which shakes the ink guided by said ink guides; and operation control means which controls an operation of said shaking means, wherein said operation control means comprises a radio frequency power supply which applies a radio frequency power to said shaking means and a timing signal generation means which generates a timing signal to operate said radio frequency power supply.

13. The ink-jet recording unit according to claim 12, wherein said radio frequency power supply generates the radio frequency power having a frequency equal to an ejection frequency or integral multiple of the ejection frequency and shakes the ink in synchronization with an ejecting operation.

14. An ink-jet recording method comprising the steps of:

applying a voltage identical in polarity with charged colorant particles agglomerated at a tip of each of ink guides arranged in an ink channel to feed ink in a form of a dispersion of the charged colorant particles in a solvent, to an ejecting electrode positioned between an ink level in the ink channel and the tip of each of the ink guides, thereby ejecting the ink from the tip of each of said ink guides; and shaking the colorant particles at the tip of each of said ink guides to agglomerate the colorant particles at the tip of each of said ink guides in preparation for a subsequent ejection of the inks, wherein an ink shaking direction conforms to an ink ejecting direction.

15. An ink-jet recording method comprising the steps of:

applying a voltage identical in polarity with charged colorant particles agglomerated at a tip of each of ink guides arranged in an ink channel to feed ink in a form of a dispersion of the charged colorant particles in a solvent, to an ejecting electrode positioned between an ink level in the ink channel and the tip of each of the ink guides;

shaking the colorant particles agglomerated at the tip of each of said ink guides while the voltage is applied to said ejecting electrode; and ejecting the ink from the tip of each of said ink guides so that the ink flied onto a recording medium is adhered to the recording medium for recording.

16. A recording head cleaning method for an ink-jet recording unit in which ink is guided to a tip of each of ink guides arranged in an ink channel to feed the ink in a form of a dispersion of charged colorant particles in a solvent to thereby agglomerate the colorant particles, a voltage identical in polarity with the colorant particles is applied to an ejecting electrode positioned between an ink level in the ink channel and the tip of each of the ink guides, and the ink is ejected from the tip of each of the ink guides by way of a repulsion exerted between the ejecting electrode and the colorant particles to let the ink fly towards a recording medium for recording onto the recording medium, said method comprising the steps of:

filling said ink channel with a cleaning solution; and shaking said cleaning solution to clean said ink guides.

17. An ink-jet recording unit comprising:

ink guides each of which is arranged in an ink channel to feed ink in a form of a dispersion of charged colorant particles in a solvent, has a tip protruded from an ink level in said ink channel, and guides the ink to the tip to agglomerate the colorant particles to eject the ink having the agglomerated colorant particles;

ejecting electrodes each of which is positioned between the ink level and the tip of each of said ink guides in a height direction of said ink guides and is provided in close proximity to each of said ink guides;

voltage application means which applies to said ejecting electrodes a high-voltage pulse which is identical in polarity with said charged colorant particles to thereby allow the ink containing the colorant particles agglomerated at the tip of each of the ink guides to be ejected;

shaking means which shakes the ink guided by said ink guides; and operation control means which controls an operation of said shaking means, wherein the shaking mean is a self-vibrating body.

* * * * *